US010443626B2

(12) United States Patent
Mielke et al.

(10) Patent No.: US 10,443,626 B2
(45) Date of Patent: Oct. 15, 2019

(54) NON UNIFORM VANE SPACING

(71) Applicant: General Electric Company, Schenectady, NY (US)

(72) Inventors: Mark Joseph Mielke, Blanchester, OH (US); Peter John Wood, Loveland, OH (US); Brian Richard Green, West Chester, OH (US); Steven Mitchell Taylor, Cincinnati, OH (US); Curtis Moeckel, Cincinnati, OH (US); Mark Joseph Frisch, Mason, OH (US); Joseph Michael Bruni, Loveland, OH (US)

(73) Assignee: General Electric Company, Schenectady, NY (US)

( * ) Notice: Subject to any disclaimer, the term of this patent is extended or adjusted under 35 U.S.C. 154(b) by 864 days.

(21) Appl. No.: 15/070,418

(22) Filed: Mar. 15, 2016

(65) Prior Publication Data

US 2017/0268537 A1 Sep. 21, 2017

(51) Int. Cl.
*F04D 29/66* (2006.01)
*F01D 9/04* (2006.01)
(Continued)

(52) U.S. Cl.
CPC ..... *F04D 29/666* (2013.01); *F01D 9/041* (2013.01); *F01D 9/042* (2013.01); *F04D 29/542* (2013.01);
(Continued)

(58) Field of Classification Search
CPC .... F04D 29/666; F04D 29/542; F04D 29/328; F01D 9/041; F01D 9/042; F05D 2220/32;
(Continued)

(56) References Cited

U.S. PATENT DOCUMENTS 1,534,721 A * 4/1925 Fritz ..... F01D 9/02 415/119
3,006,603 A * 10/1961 Caruso ..... F01D 5/043 415/1
(Continued)

FOREIGN PATENT DOCUMENTS

CN 105264237 A 1/2016
GB 1058759 A 2/1967

OTHER PUBLICATIONS

Office Action issued in connection with corresponding CA Application No. 2959676 dated Jan. 30, 2018.
(Continued)

*Primary Examiner* — Timothy L Maust
(74) *Attorney, Agent, or Firm* — General Electric Company; William Scott Andes

(57) ABSTRACT

A circular row of non-uniformally spaced vanes includes only one first group and only one second group of adjacent vanes, unequal first and second spacing between adjacent vanes in the first and second groups, and first spacing greater than second spacing. An embodiment with second group including only three adjacent vanes. Second spacing may be about 25%-35% smaller than a nominal uniform spacing used as a design parameter for designing spacing of the non-uniformly spaced stator vanes. Circular row may be sectored. A gas turbine engine section may include one or more rings or circular rows of fixed and/or variable non-uniformally spaced vanes. Method for designing non-uniform vane spacing for circular row includes determining nominal uniform spacing and forming first spacing and second spacing from nominal uniform spacing of vanes.

17 Claims, 7 Drawing Sheets

(51) Int. Cl.
*F04D 29/54* (2006.01)
*F04D 29/32* (2006.01)

(52) U.S. Cl.
CPC ..... *F04D 29/328* (2013.01); *F05D 2220/32* (2013.01); *F05D 2240/12* (2013.01); *F05D 2240/128* (2013.01); *F05D 2250/30* (2013.01); *F05D 2260/961* (2013.01)

(58) Field of Classification Search
CPC ..... F05D 2240/12; F05D 2240/128; F05D 2250/30; F05D 2260/961
USPC ..... 415/119, 195
See application file for complete search history.

(56) References Cited

U.S. PATENT DOCUMENTS 3,347,520 A * 10/1967 Oweczarek ..... F01D 5/14 415/119
3,556,680 A * 1/1971 Leutwyler et al. ..... F04F 13/00 415/119
4,084,922 A * 4/1978 Glenn ..... F01D 5/3053 416/193 A
5,681,145 A 10/1997 Neely et al.
6,439,838 B1 8/2002 Crall et al.
7,097,420 B2 8/2006 Cormier et al.
7,367,775 B2 * 5/2008 Borufka ..... F01D 5/027 415/119
7,743,497 B2 6/2010 Gautreau et al.
8,277,166 B2 10/2012 Tecza et al.
8,534,991 B2 * 9/2013 Topol ..... F01D 5/16 415/119
8,678,752 B2 * 3/2014 Delvaux ..... F01D 5/142 415/119
8,684,685 B2 * 4/2014 Delvaux ..... F01D 5/3007 415/195
8,757,965 B2 * 6/2014 Baralon ..... F01D 9/041 415/142
2005/0232763 A1 10/2005 Cormier et al.
2007/0079506 A1 4/2007 Gautreau et al.
2011/0274537 A1 11/2011 Duong et al.
2013/0094942 A1 4/2013 MacKay et al.
2013/0149135 A1 6/2013 Hield

OTHER PUBLICATIONS

Machine translation of First Office Action and Search issued in connection with corresponding CN Application No. 2017101555231 dated Aug. 31, 2018.

* cited by examiner

NON UNIFORM VANE SPACING

BACKGROUND OF THE INVENTION

Technical Field

This invention relates to aircraft gas turbine engine stator vanes and, particularly, to non-uniform vane spacing.

Background Information

Stator vanes are commonly used in aircraft gas turbine engine compressors and fans and in some turbine designs. Non-rotating or stationary stator vanes typically are placed downstream or upstream of rotor blades of the fans, compressors, and turbines. These vanes influence the tangential flow component entering or leaving the rotors, may increase the static pressure of the fluid and may set the flow angle to a level appropriate for the downstream rotor. Non-rotating stationary stator vanes may be variable stator vanes capable of having their angle varied or may be fixed and not able to vary their angle with respect to the incoming gas flow.

Airfoils in vanes have a series of excitation frequencies associated with them. More specifically, each airfoil produces a wake in an air stream that is felt as a pulse by a passing airfoil. The combination of the number of stator vane wakes (pulses) and the rotational speed of the compressor creates a stimulus that may coincide with a natural frequency of the rotor blades. It is highly desirable to keep the majority of the airfoil natural frequencies outside of the designed engine operating range.

Non-uniform vane spacing (NUVS) designs have been developed to reduce induced rotor blade vibrations. NUVS designs vary the vane spacing around the circumference of the engine casing to facilitate avoidance of rotor blade and stator vane natural frequencies or to reduce the amplitude of rotor blade resonant response at these frequencies. More specifically, within such designs the number of stator vanes is varied in one or more sectors of the stator vane assembly. Although the stator vane spacing may vary from one sector to the next, the stator vanes within each sector remain equally spaced relative to each other, and/or are designed with an equal pitch. The variation in vane spacing or pitch between stator vane sectors facilitates changing the frequency of the vane wakes to reduce the vibration response induced in adjacent rotor blades. Some conventional non-uniform vane spacing designs can cause compressor performance and operability issues. Some conventional non-uniform vane spacing designs can require a large number of vane sector configurations with associated manufacturing and inventory costs.

Thus, it is desirable to have non-uniform vane spacing compressor designs that avoid a large number of vane sector configurations and/or compressor performance and operability issues.

BRIEF DESCRIPTION OF THE INVENTION

A gas turbine engine ring or circular row of non-uniformally spaced vanes includes first group and second groups including all the vanes in the ring or circular row, only one first group and only one second group of adjacent vanes, unequal first and second spacing between the adjacent vanes in the first and second groups respectively, and the first spacing greater than the second spacing.

The second group may include only three adjacent vanes and only two adjacent pairs of the vanes and the second spacing between each of the vanes in each of the two adjacent pairs. A nominal uniform spacing of the stator vanes may be used as a design parameter for designing the spacing of the non-uniformly spaced stator vanes and the second spacing may be about 25%-35% smaller than the nominal uniform spacing. The gas turbine engine ring or circular row may be sectored. The gas turbine engine ring or circular row may include about 9 to 14 sectors and about 8 to 16 vanes per sector.

The second group may include two or more adjacent vanes including one or more adjacent pairs of the vanes and the second spacing being between each of the one or more adjacent pairs of the vanes respectively.

A gas turbine engine assembly may include a gas turbine engine section including one or more rings or circular rows of fixed and/or variable non-uniformally spaced vanes, first group and second groups including all the vanes in each of the one or more rings or circular rows, only one first group and only one second group of adjacent vanes in each of the one or more rings or circular rows, unequal first and second spacing between the adjacent vanes in the first and second groups respectively, and the first spacing greater than the second spacing.

A method for designing non-uniform vane spacing for a ring or circular row of non-uniformally spaced gas turbine engine vanes includes determining a 360 degree nominal uniform spacing S pattern, spreading apart one interim pair of the nominal uniformally spaced apart vanes and moving the remaining vanes closer together wherein the remaining vanes are all evenly spaced at a first spacing creating one big gap or an interim large spacing between the interim pair, and inserting an additional vane in the one big gap or interim large spacing forming two adjacent equal narrow gaps or spaces having second spacings smaller than the first spacing.

DETAILED DESCRIPTION OF THE INVENTION

Figure 1:
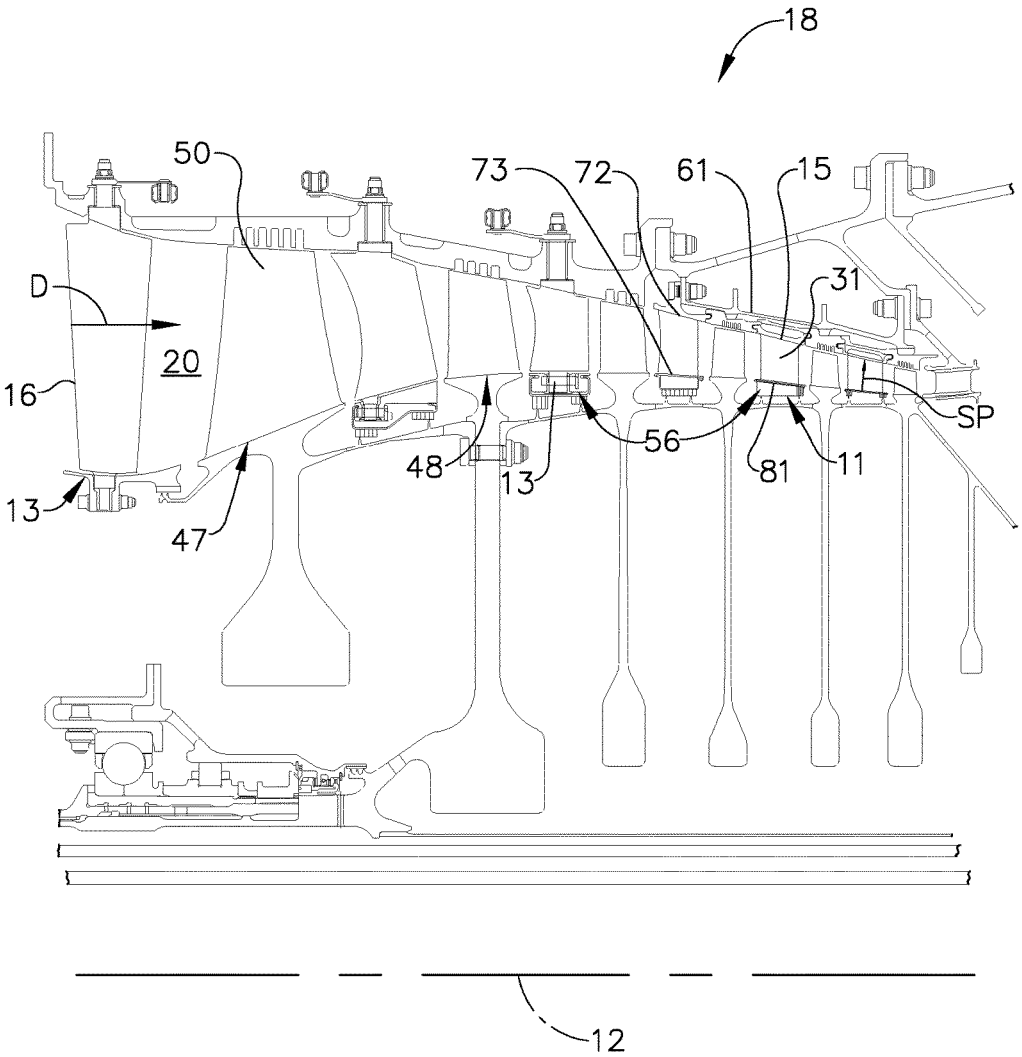
FIG. 1 is a diagrammatical view illustration of a gas turbine engine high pressure compressor with stator vanes with non-uniform vane spacing (NUVS).
Figure 2:
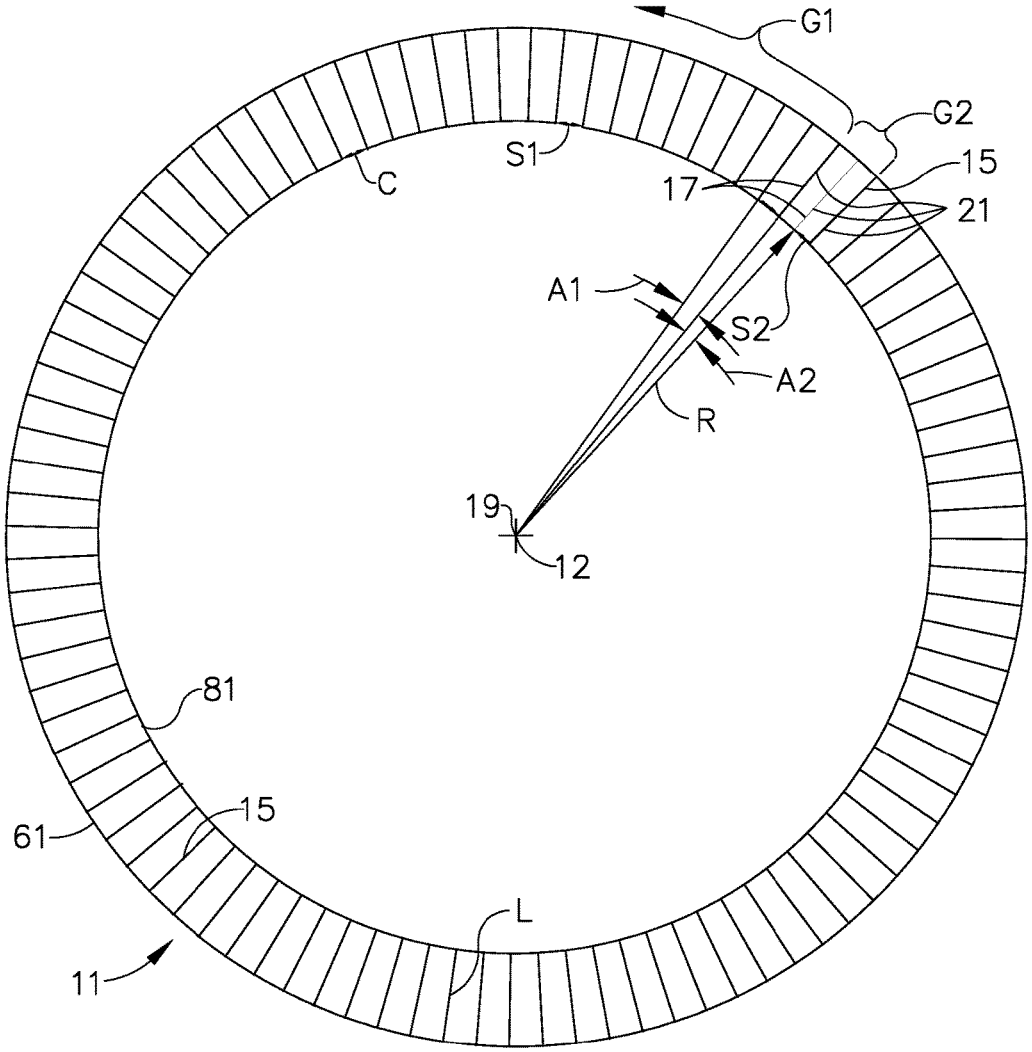
FIG. 2 is a diagrammatical axial view illustration of a row of non-uniformly spaced stator vanes.

Illustrated in FIG. 1 is an exemplary gas turbine engine high pressure compressor 18 with at least one ring or circular row 11 of stator vanes 15 with non-uniform vane spacing (NUVS) illustrated in FIG. 2. A circular ring or row 13 of inlet variable stator vanes 16 which may have non-uniform vane spacing (NUVS) are also illustrated as being disposed in the compressor 18 and are used to optimize the direction at which gases flowing downstream D through a compressor flowpath 20 of the compressor 18 enter first and second rows 47, 48 of rotatable blades 50. The circular rows 11 of the fixed or variable stator vanes 15 are axisymmetrical about a longitudinal or axial centerline axis 12.

The high pressure compressor 18 is generally axisymmetrical about the longitudinal or axial centerline axis 12. A circular ring or row 13 of inlet variable stator vanes 16 which may have non-uniform vane spacing (NUVS) are disposed in the compressor 18 and used to optimize the direction at which gases flowing downstream D through the compressor 18 enter the first and second rows 47, 48 of rotatable blades 50. Though the exemplary embodiment of the stator vanes 15 with non-uniform vane spacing disclosed herein is for a high pressure compressor 18, similar stator vanes 15 with non-uniform vane spacing disclosed herein may be used in other compressor sections and in fan and turbine sections of a gas turbine engine as well. A compressor casing 61 radially outwardly supports stator vane assemblies 56 which include the stator vanes 15.

Referring to FIGS. 1 and 2, at least one stator vane assembly 56 or circular row 11 of stator vanes 15 includes a plurality of stator vanes 15. Each stator vane 15 has an airfoil 31 radially disposed between the casing 61 and an inner ring 81 which is spaced radially inwardly of the casing 61. The airfoil 31 extends inwardly from an airfoil outer end 72 to an airfoil inner end 73 along a span SP of the airfoil. The stator vanes may be or variable, capable of having their angle varied as illustrated in FIG. 1.

Figure 2A:
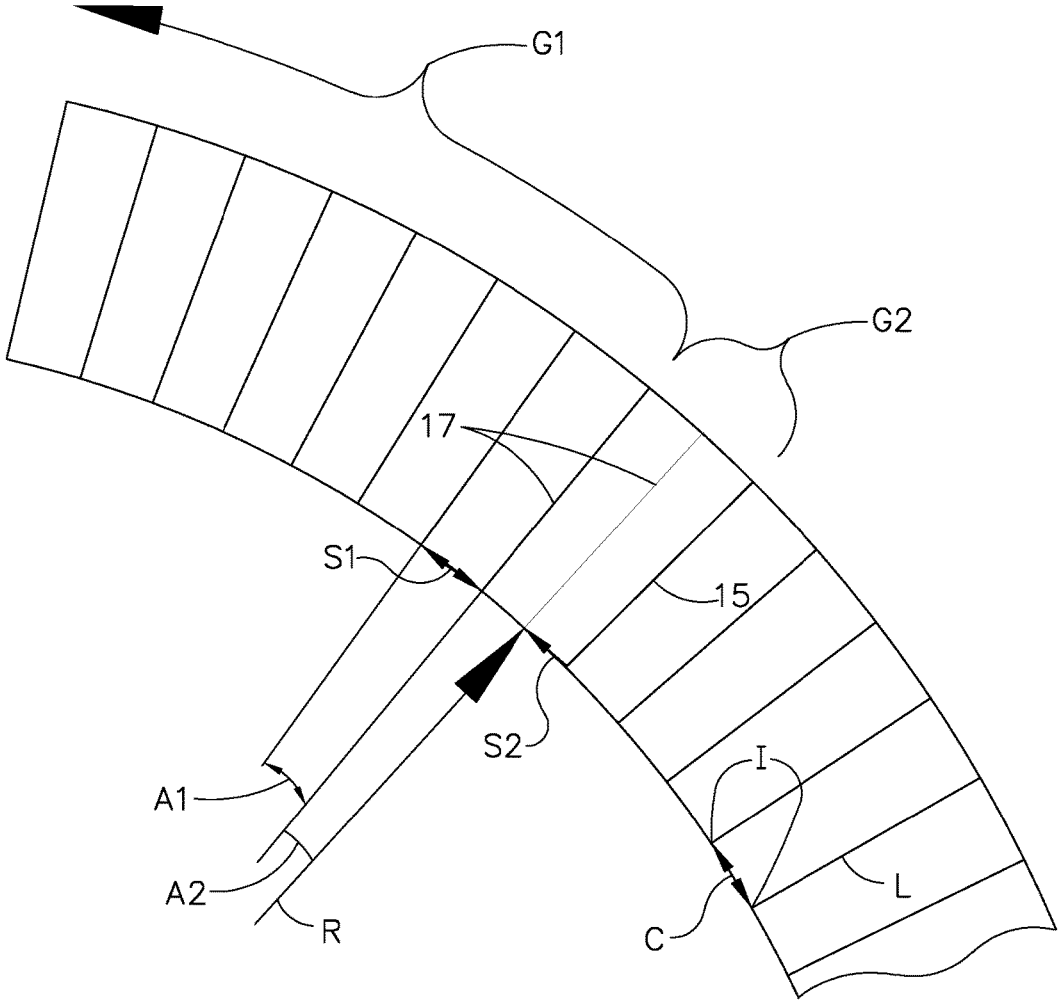
FIG. 2A is an enlarged portion of the diagrammatical axial view illustration of the row of non-uniformly spaced stator vanes illustrated in FIG. 2.

In order to reduce induced rotor blade vibration amplitudes, at least one of the variable stator vane assemblies 56 or circular rows 11 of stator vanes 15 include non-uniform vane spacing indicated by unequal first and second spacing S1, S2 between the vanes 15 in first and second groups G1, G2 respectively of the vanes 15, as illustrated in FIGS. 2 and 2A. As illustrated herein, the exemplary first spacing S1 is greater than the exemplary second spacing S2. The unequal first and second spacing S1, S2 are circular or linear distances between the vanes 15. Adjacent vanes 15 in the first and second groups G1, G2 have the same first and second spacing S1, S2 respectively between them.

S1, S2 may be measured circumferentially along an arc C between an adjacent pair 17 of the vanes 15. The arc C extends between a pair of adjacent radii R having a common origin 19 on the axial centerline axis 12 and pass through the adjacent pair 17 of the vanes 15 respectively. S1, S2 may be measured linearly from the intersections I of the arc C and the adjacent pair 17 of adjacent radii R having the common origin 19 on the axial centerline axis 12.

The non-uniform vane spacing may also be angular and measured in degrees between the vanes 15. The non-uniform vane spacing may be indicated by unequal first and second angles A1, A2 as measured between the vanes 15 in the first and second groups G1, G2 respectively of the vanes 15 as illustrated in FIG. 2. The radii R may be along centerlines L of the vanes 15 and the unequal first and second angles A1, A2 may be measured between these adjacent radii R.

Figure 6:
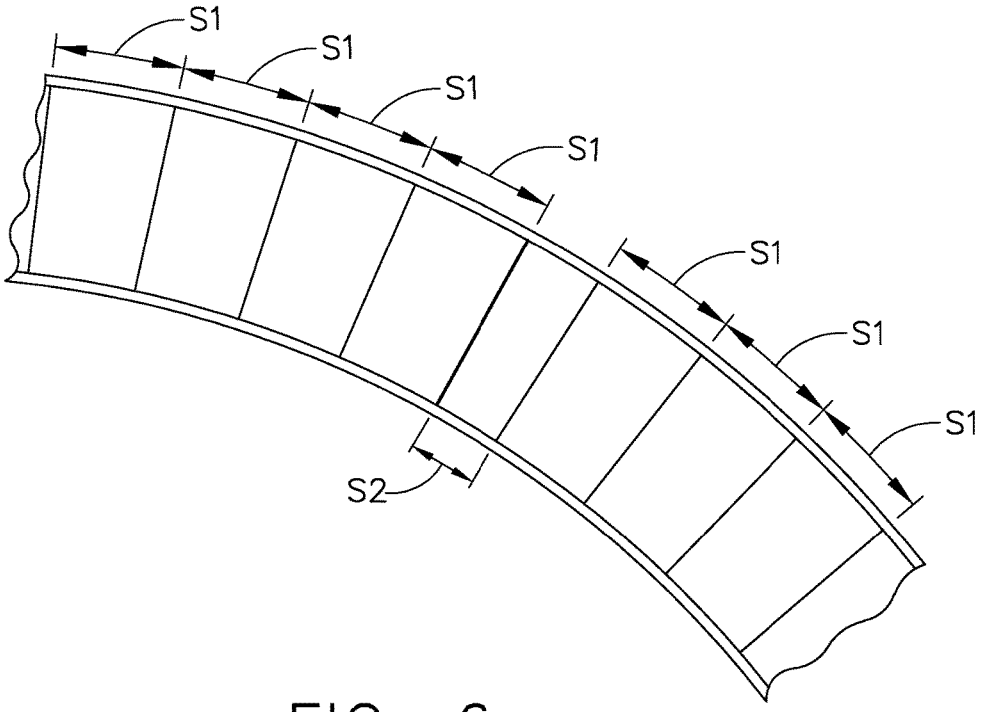
FIG. 6 is a diagrammatical axial view illustration of another of the non-uniformly spaced stator vanes illustrated in FIG. 2.

The exemplary embodiment of the non-uniform vane spacing illustrated herein in the circular row 11 of non-uniformly spaced stator vanes 15 includes only a single first group G1 and only a single second group G2. One of the groups includes widely spaced stator vanes 15 and the other group includes narrowly spaced stator vanes 15. The embodiment of the circular row 11 of non-uniformly spaced stator vanes 15, illustrated in FIG. 2, illustrates the single first group G1 as including the widely spaced vanes 15. FIG. 2 also illustrates the single second group G2 as including the narrowly spaced apart vanes 15. Only three narrowly spaced vanes 15 spaced narrowly apart with the second spacing S2 between the vanes 15. Other embodiments may have only two narrowly spaced apart vanes 15 with a second spacing S2 between them as illustrated in FIG. 6. In general the circular row 11 of non-uniformly spaced stator vanes 15 includes a second group G2 of two or more narrowly spaced apart vanes 15 having a second small or narrow spacing S2 therebetween.

Figure 3:
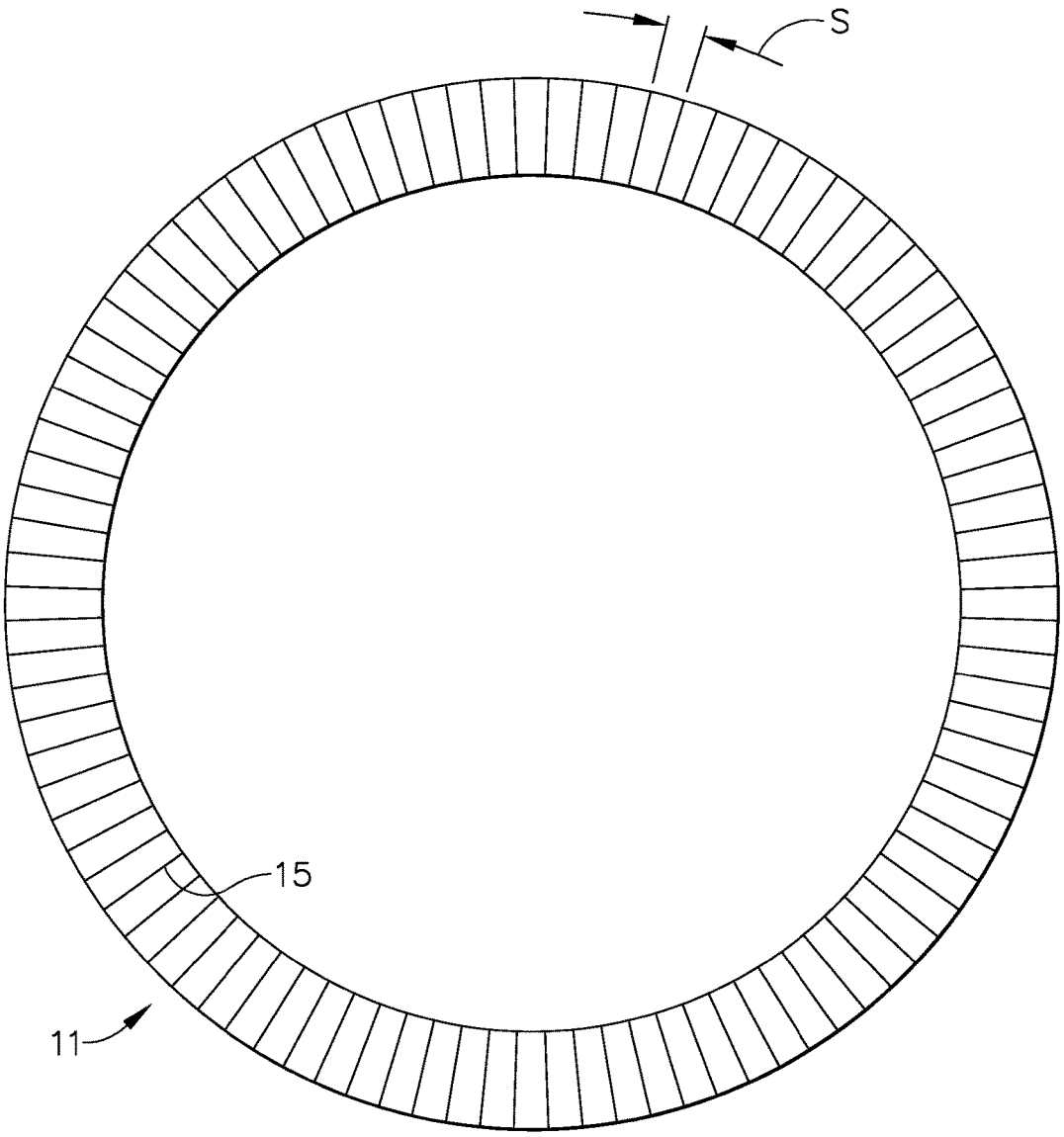
FIG. 3 is a diagrammatical axial view illustration of equally or uniformally spaced apart stator vane spacing design that may be used in a method of designing the row of non-uniformly spaced stator vanes illustrated in FIG. 2.
Figure 4:
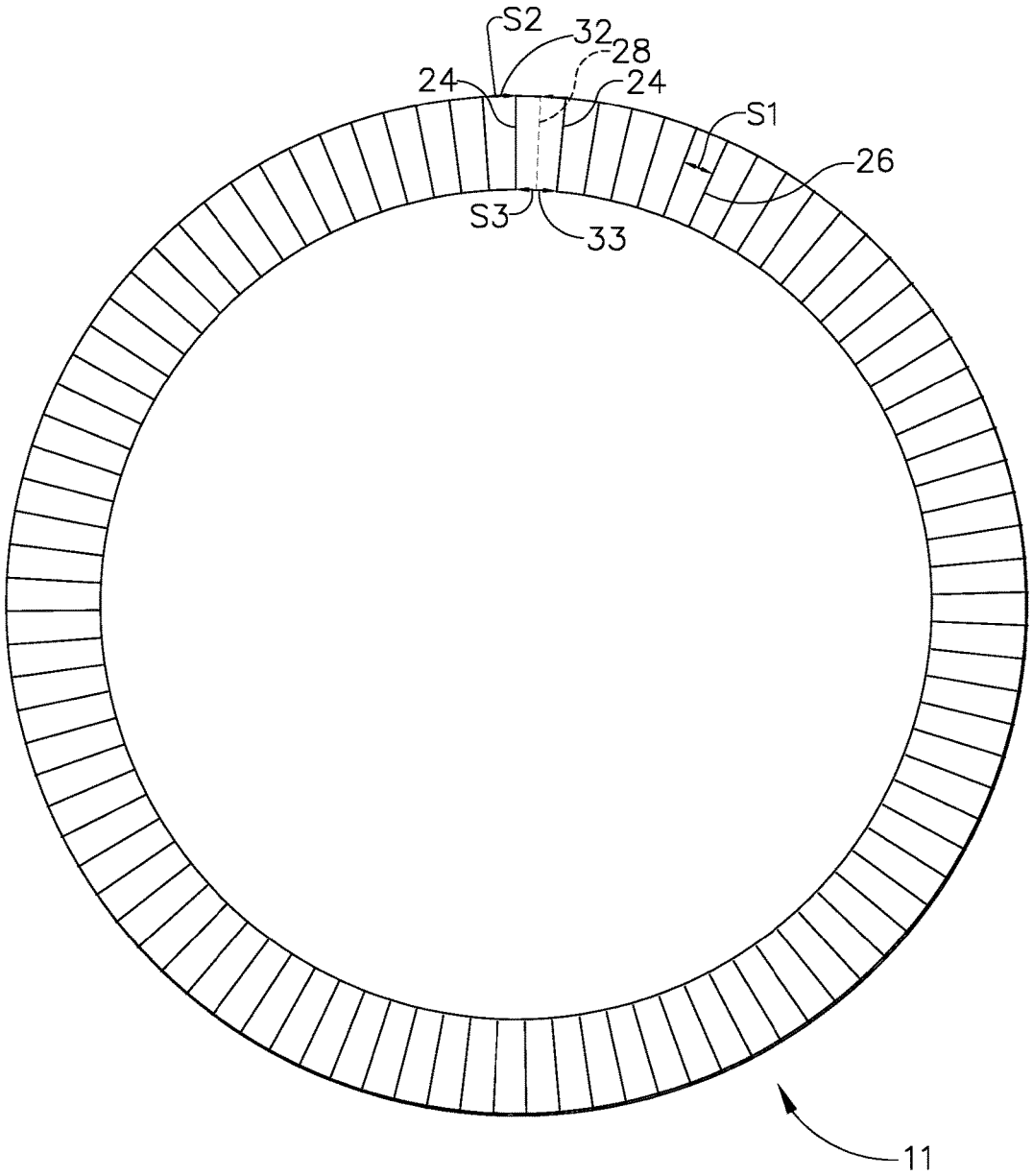
FIG. 4 is a diagrammatical axial view illustration of a subsequent spaced apart stator vane spacing design based on the design illustrated in FIG. 3 and that may be used in a method of designing the row of non-uniformly spaced stator vanes illustrated in FIG. 2.

In the design of such spacing, one method may start with a 360 degree equal or uniform spacing S pattern as illustrated in FIG. 3. The uniform spacing S is a nominal spacing which is a design parameter used in designing the spacing of the non-uniformly spaced stator vanes 15. FIG. 4 illustrates a subsequent step in the design method in which an interim pair 24 of the spaced apart vanes 15 illustrated in FIG. 3 are spread apart and the remaining vanes 26 are all evenly spaced closer together at what is the first spacing S1, illustrated in FIG. 2, thus, creating one big gap 33 or with an interim large spacing S3 between the interim pair 24 of the spaced apart vanes 15. The first spacing S1 is somewhat smaller than the nominal or uniform spacing S. Then an additional vane 28 is inserted in the one big gap 33 or interim large spacing S3 to turn it into two equal narrow gaps or spaces 32 which denoted by or illustrated by the second spacing S2 in FIG. 2 by the three narrowly spaced apart adjacent vanes 21. The second spacing S2 is substantially smaller than the nominal or uniform spacing S and in the embodiment illustrated herein the second spacing S2 is about 65%-75% of the nominal or uniform spacing S. Put another way the second spacing S2 is about 25%-35% smaller than the nominal or uniform spacing S.

Figure 5:
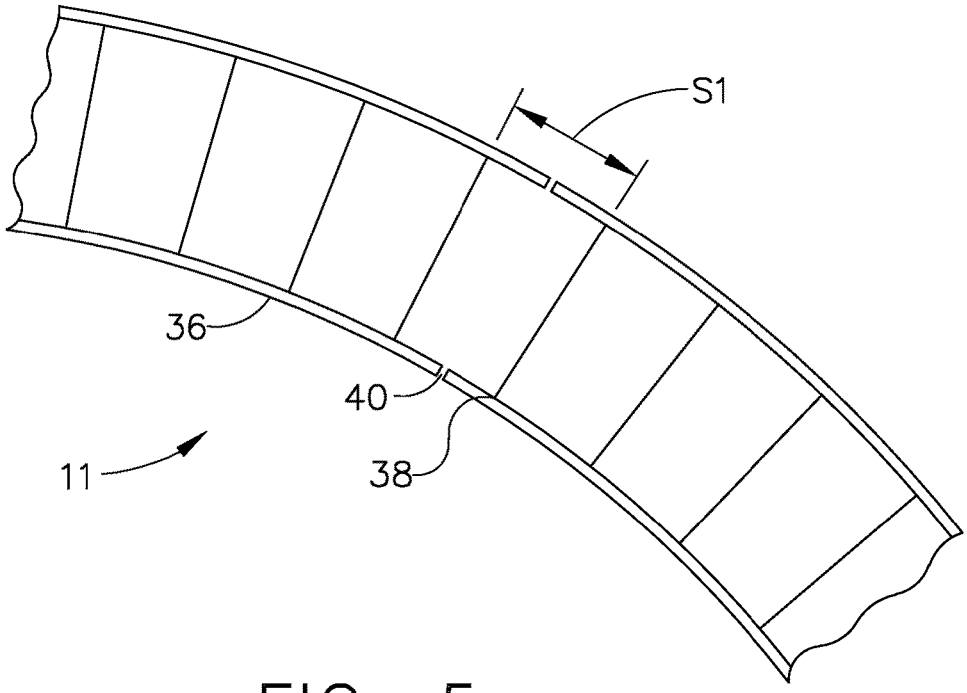
FIG. 5 is a diagrammatical axial view illustration of portions of two adjacent sectors of a sectored embodiment of the row of non-uniformly spaced stator vanes illustrated in FIG. 2.

The ring or circular row 11 of stator vanes 15 with non-uniform vane spacing may be sectored as illustrated by first and second sectors 36, 38 separated by splits 40 as illustrated in FIG. 5. The sectored embodiment of the row of non-uniformly spaced stator vanes illustrated in FIG. 5 may include several sectors and several vanes 15 in each sector. The exemplary embodiment illustrated herein includes 9 to 14 sectors per gas turbine engine compressor stage and about 8-16 vanes per sector.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

What is claimed:

1. A gas turbine engine ring or circular row of non-uniformally spaced vanes comprising:

a plurality of non-uniformly circumferentially spaced vanes, all the vanes in the ring or circular row forming a first group of adjacent vanes having a first spacing between adjacent vanes of the first group and a second group of adjacent vanes having a second spacing between adjacent vanes of the second group, the plurality of vanes forming only one first group of adjacent vanes and only one second group of adjacent vanes with only two defined first and second spacings between adjacent vanes in the ring or circular row, the first spacing and the second spacing being unequal, and the first spacing being greater than the second spacing.

2. The gas turbine engine ring or circular row as claimed in claim 1 further comprising the second group including only three adjacent vanes forming only two adjacent pairs of vanes and the second spacing being defined between each adjacent pair of vanes in the second group.

3. The gas turbine engine ring or circular row as claimed in claim 2 further comprising a nominal uniformal spacing of the vanes used as a design parameter for designing the spacing of the non-uniformly spaced vanes and the second spacing being about 25%-35% smaller than the nominal uniformal spacing.

4. The gas turbine engine ring or circular row as claimed in claim 3 further comprising the gas turbine engine ring or circular row being sectored.

5. The gas turbine engine ring or circular row as claimed in claim 4 further comprising the gas turbine engine ring or circular row including about 9 to 14 sectors and about 8 to 16 vanes per sector.

6. The gas turbine engine ring or circular row as claimed in claim 1 further comprising the gas turbine engine ring or circular row being sectored.

7. The gas turbine engine ring or circular row as claimed in claim 6 further comprising the gas turbine engine ring or circular row including about 9 to 14 sectors and about 8 to 16 vanes per sector.

8. The gas turbine engine ring or circular row as claimed in claim 1 further comprising the second group including one or more adjacent vanes including one or more adjacent pairs of the vanes and the second spacing being between each of the one or adjacent pairs of the vanes respectively.

9. The gas turbine engine ring or circular row as claimed in claim 8 further comprising the gas turbine engine ring or circular row being sectored.

10. The gas turbine engine ring or circular row as claimed in claim 9 further comprising the gas turbine engine ring or circular row including about 9 to 14 sectors and about 8 to 16 vanes per sector.

11. A gas turbine engine assembly comprising:

a gas turbine engine section including one or more rings or circular rows of fixed and/or variable non-uniformally spaced vanes, each of the one or more rings or circular rows comprising:

a plurality of non-uniformly circumferentially spaced vanes, all the vanes in each of the one or more rings or circular rows forming a first group of adjacent vanes having a first spacing between adjacent vanes of the first group and a second group of adjacent vanes having a second spacing between adjacent vanes of the second group, the plurality of vanes forming only one first group of adjacent vanes and only one second group of adjacent vanes with only two defined first and second spacings between adjacent vanes in each of the one or more rings or circular rows, the first spacing and the second spacing being unequal, and the first spacing being greater than the second spacing.

12. The gas turbine engine assembly as claimed in claim 11 further comprising the second group including only three adjacent vanes forming only two adjacent pairs of vanes and the second spacing being defined between each adjacent pair of vanes in the second group.

13. The gas turbine engine assembly as claimed in claim 12 further comprising a nominal uniformal spacing of the vanes used as a design parameter for designing the spacing of the non-uniformly spaced vanes and the second spacing being about 25%-35% smaller than the nominal uniformal spacing.

14. The gas turbine engine assembly as claimed in claim 13 further comprising the gas turbine engine rings or circular rows being sectored.

15. The gas turbine engine assembly as claimed in claim 14 further comprising the gas turbine engine rings or circular rows including about 9 to 14 sectors and about 8 to 16 vanes per sector.

16. The gas turbine engine assembly as claimed in claim 11 further comprising the gas turbine engine rings or circular rows being sectored.

17. The gas turbine engine assembly as claimed in claim 16 further comprising the gas turbine engine rings or circular rows including about 9 to 14 sectors and about 8 to 16 vanes per sector.

* * * * *